US012522997B2

(12) United States Patent
Huber

(10) Patent No.: US 12,522,997 B2
(45) Date of Patent: Jan. 13, 2026

(54) MEASURING ARRANGEMENT AND REMOVAL DEVICE WITH A MEASURING ARRANGEMENT

(71) Applicant: BAUER Maschinen GmbH, Schrobenhausen (DE)

(72) Inventor: Ludwig Andreas Huber, Thalhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 403 days.

(21) Appl. No.: 18/546,391

(22) PCT Filed: Mar. 11, 2022

(86) PCT No.: PCT/EP2022/056289
§ 371 (c)(1),
(2) Date: Aug. 14, 2023

(87) PCT Pub. No.: WO2022/200074
PCT Pub. Date: Sep. 29, 2022

(65) Prior Publication Data

US 2024/0133146 A1 Apr. 25, 2024
US 2024/0229404 A9 Jul. 11, 2024

(30) Foreign Application Priority Data

Mar. 23, 2021 (EP) ..... 21164313

(51) Int. Cl.
*E02D 13/06* (2006.01)
*E02D 17/13* (2006.01)

(52) U.S. Cl.
CPC ..... *E02D 13/06* (2013.01); *E02D 17/13* (2013.01)

(58) Field of Classification Search
CPC ..... E02D 13/06; E02D 17/13; E02F 3/205; E02F 3/475; E02F 9/264
See application file for complete search history.

(56) References Cited

U.S. PATENT DOCUMENTS 10,280,585 B2 * 5/2019 Steff De Verninac ..... G01R 33/02
10,822,767 B2 * 11/2020 Huber ..... E02F 3/22
(Continued)

FOREIGN PATENT DOCUMENTS

EP 0 518 298 A1 12/1992
EP 0802286 A2 * 10/1997 ..... E02D 17/06
(Continued)

OTHER PUBLICATIONS

International Search Report issued in PCT/EP2022/056289; mailed Jun. 1, 2022.
(Continued)

*Primary Examiner* — Yaritza Guadalupe-McCall
(74) *Attorney, Agent, or Firm* — Studebaker Brackett PLLC

(57) ABSTRACT

The invention relates to a measuring arrangement for measuring a position, in particular a verticality, of a vertically adjustable and lowerable working apparatus with respect to an upper fixed point, with at least one measuring cable which is on the one hand connected to the vertically adjustable working apparatus and on the other hand extends towards the fixed point, at least one measuring means which is connected to the corresponding measuring cable and designed to measure an angle of inclination of the measuring cable relative to a vertical measurement axis and is arranged in a connection region between the measuring cable and the working apparatus, and at least one connecting means which is arranged between the measuring means and the working apparatus and designed to keep the measuring means torsion
(Continued)

Figure 1:
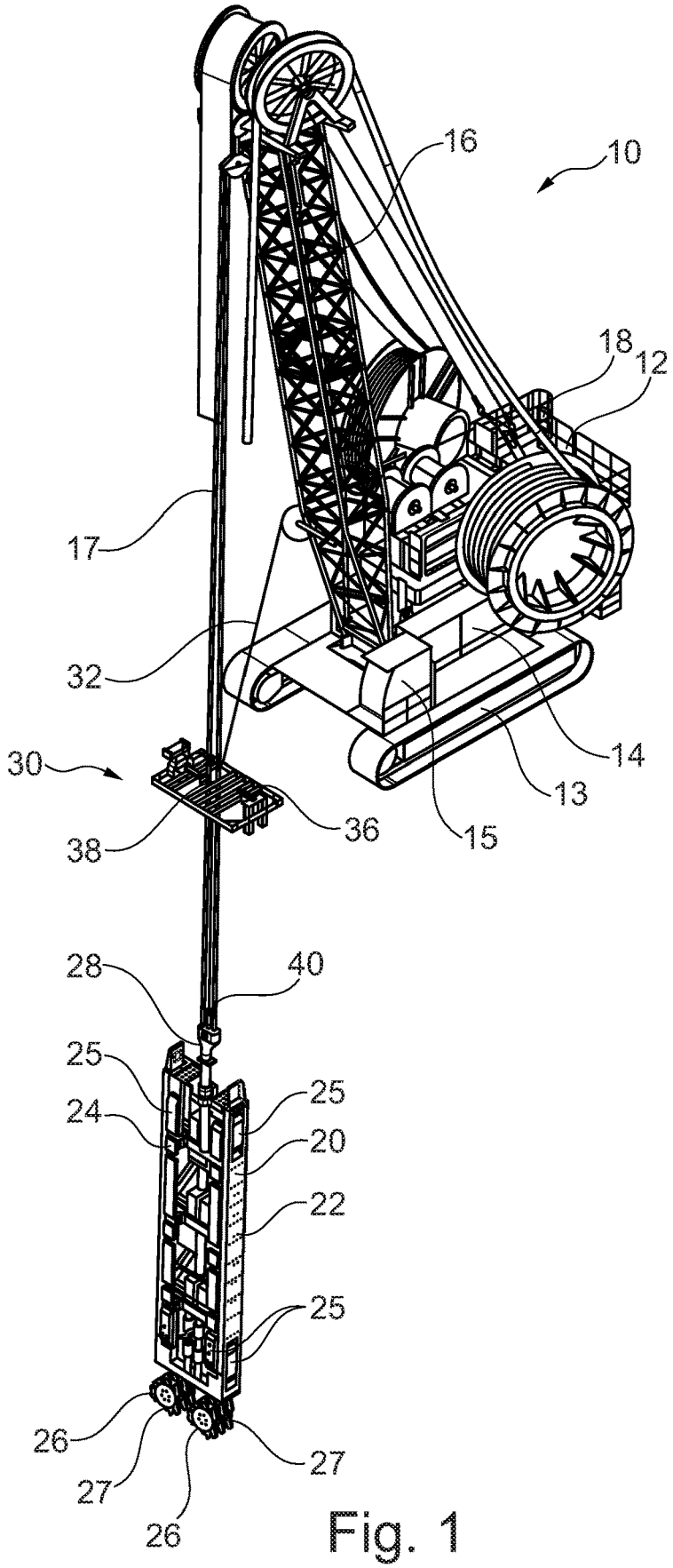

proof about the vertical measurement axis and at the same time capable of being angled with respect to the vertical measurement axis on the working apparatus. According to the invention provision is made in that the connecting means has a connecting tube which is arranged coaxially to the vertical measurement axis, and in that the connecting tube is designed so as to be torsion proof about the vertical measurement axis and deflectable with respect to the vertical measurement axis.

15 Claims, 3 Drawing Sheets

(56) References Cited

U.S. PATENT DOCUMENTS

| | | | | |
|---|---|---|---|---|
| 2014/0041447 | A1* | 2/2014 | Schwanz | E21B 47/02 73/152.48 |
| 2016/0145825 | A1* | 5/2016 | Steff De Verninac | E02F 1/00 405/284 |
| 2019/0277132 | A1* | 9/2019 | Mosser | E21B 47/022 |
| 2024/0133146 | A1* | 4/2024 | Huber | E02D 13/06 |
| 2024/0229404 | A9* | 7/2024 | Huber | E02F 3/475 |
| 2024/0240427 | A1* | 7/2024 | Wiedenmann | F04D 9/005 |
| 2024/0360726 | A1* | 10/2024 | Semel | E21B 34/12 |
| 2025/0179758 | A1* | 6/2025 | Herrmann | E02D 17/13 |
| 2025/0283293 | A1* | 9/2025 | Weixler | E02F 3/58 |
| 2025/0290277 | A1* | 9/2025 | Florian | E02F 5/08 |

FOREIGN PATENT DOCUMENTS

| | | | | |
|---|---|---|---|---|
| EP | 0841465 | A1 * | 5/1998 | G01C 9/00 |
| EP | 0 841 465 | B1 | 8/2003 | |
| EP | 1703023 | A1 * | 9/2006 | E02D 17/13 |
| EP | 2698499 | A1 * | 2/2014 | E21B 47/022 |
| EP | 2 698 499 | B1 | 11/2014 | |
| EP | 3 536 899 | A1 | 9/2019 | |

OTHER PUBLICATIONS

International Preliminary Report On Patentability and Written Opinion issued in PCT/EP2022/056289; issued Sep. 12, 2023.

* cited by examiner

MEASURING ARRANGEMENT AND REMOVAL DEVICE WITH A MEASURING ARRANGEMENT

The invention relates to a measuring arrangement with at least one measuring cable which is on the one hand connected to the vertically adjustable working apparatus and on the other hand extends towards an upper fixed point, at least one measuring means which is connected to a corresponding measuring cable and designed to measure an angle of inclination of the measuring cable relative to a vertical measurement axis and is arranged in a connection region between the measuring cable and the working apparatus, and at least one connecting means which is arranged between the measuring means and the working apparatus and is designed to keep the measuring means torque proof about the vertical measurement axis and at the same time capable of being angled with respect to the vertical measurement axis on the working apparatus, in accordance with the preamble of claim 1.

The invention further relates to a removal device for producing a hole, in particular a trench, in the ground, with a working apparatus which has at least one removal tool for removing ground, a carrier implement, on which the working apparatus is supported in a vertically adjustable manner for introduction into the ground, and a measuring arrangement for measuring the position, in particular a verticality, of the working apparatus in the ground, in accordance with the preamble of claim 10.

When producing a trench in the ground due to various influencing factors deviations from a desired vertical alignment or position of the trench may occur. A precise positionally accurate production of a trench in the ground is of vital importance for example when producing a diaphragm wall as it is required e.g. for sealing deep excavation pits against in-situ ground water. Such a diaphragm wall is produced of a plurality of individual trenches that are filled with a settable mass. In this process, it is necessary to produce the individual diaphragm wall segments precisely next to each other so as to prevent the occurrence of gaps and therefore leakages between the diaphragm wall segments.

A highly accurate method for measuring a borehole in the ground by means of at least one measuring cable which extends from a measuring body up to a carrier implement is known from EP 2 698 499 B1. In this known method, however, an apparatus-independent measuring apparatus is required, with which an angle and distance measurement are to be carried out. In this case, a change of position on the measuring cables can serve as a measure for the alignment and in particular the verticality of the hole in the ground. However, this measuring arrangement cannot be directly employed for the control of a removal device.

A generic measuring arrangement can be taken from EP 0 841 465 B1. In this known measuring arrangement two mutually spaced measuring cables are tensioned from predetermined fixed points on a ground surface up to a diaphragm wall cutter. If the diaphragm wall cutter is lowered vertically with precision the measuring cables are vertically aligned. In the case of a deviation of the diaphragm wall cutter from the vertical an angle of inclination occurs on the measuring cable. The measured angle can be established by way of inclinometers at the connection region between the measuring cables to the working apparatus. In order to establish even minor deviations with the highest possible accuracy the measuring cables have to be attached to the working apparatus such that they are as freely adjustable as possible. For this purpose, EP 0 841 465 B1 teaches the attachment of a ball joint or a cardanic joint with intersecting pivot axes.

With regard to this measuring arrangement a specific cardanic bearing is taught in EP 3 536 899 A1, with which a particularly good measuring precision is to be achieved. The cardanic bearing has a plurality of mechanical parts which, however, when employed on construction sites and especially when introducing the working apparatus with such a measuring means into trenches filled with concrete suspension, require a great time and effort of cleaning and maintenance. In the case of insufficient cleaning and maintenance of the delicate mechanical cardanic linkage undesirable measuring inaccuracies may occur.

The invention is based on the object to provide a measuring arrangement and a removal device with such a measuring arrangement which, whilst being of robust design, enable a particularly reliable and precise measurement.

The object is achieved by a measuring arrangement having the features of claim 1 and by a removal device having the features of claim 10. Preferred embodiments of the invention are stated in the dependent claims.

The measuring arrangement according to the invention is characterized in that the connecting means has a connecting tube which is arranged coaxially to the vertical measurement axis and in that the connecting tube is configured to be torsionally rigid about the vertical measurement axis and deflectable with respect to the vertical measurement axis.

A basic idea of the invention resides in the fact that for connection of the measuring means to the working apparatus a connecting tube is provided which is on the one hand torsionally rigid about the tubular axis that coincides with the measurement axis and on the other hand is deflectable or bendable with respect to the tubular axis. The use of such a connecting tube offers advantages in various respects. Unlike a cardan joint with intersecting pivot axes the connecting tube has a uniform deflection behavior over its entire circumference. Moreover, a connecting tube as a joint element is simple and at the same time robust as it basically is of one-piece design. In particular, it is less sensitive to external influences and requires a considerably smaller time and effort of maintenance and cleaning as compared to a multi-part cardan joint or a ball joint, especially if contact with a settable suspension or with dirt particles is to be expected. The measuring arrangement according to the invention is therefore particularly suited for rough work assignment on construction sites or in other outdoor areas.

Basically, the connecting tube can be made of any suitable material that is sufficiently torsionally rigid about the tubular axis and permits a desired deflectability in a direction transverse to the tubular axis. According to an embodiment of the invention it is especially preferred that the connecting tube is formed in a hose-like manner of a flexible material. In particular, a plastic material, more particularly an elastic plastic material is suitable to form the connecting tube.

According to an embodiment variant of the invention an improvement of the deflectability and thus of the sensitivity of the measuring arrangement is achieved in that the connecting tube is at least in sections designed as a corrugated tube with a corrugated wall region. Hence, the connecting tube has at least one region with changing diameters, in particular increasing and decreasing diameters. By preference, the tube can also be designed in its entirety as a corrugated tube. It is preferred that the corrugated tube is manufactured from a metal material, for instance steel or stainless steel.

According to another preferred embodiment of the invention an increase in the axial stiffness of the connecting tube concomitant with a continued sensitive angle capability of the tube can be achieved in that the connecting tube is filled with an incompressible liquid. Preferably, an oil or water can be provided as liquid.

Another preferred embodiment of the invention resides in the fact that at the end of the connecting tube which is directed towards the working apparatus a rotary bearing is provided, with which the connecting tube is rotatable about the vertical measurement axis, in particular about an angle of 180°. Basically, the rotary bearing can be arranged in any position of the connecting tube. Due to the rotatability of the connecting tube about the measurement or tubular axis the measurement accuracy can be increased still further.

In particular, this can be accomplished in that a rotary drive is arranged for rotating the rotatably supported connecting tube in at least one different position and in that the measuring means is designed to measure the angle of inclination in the different rotational positions. In particular, following measurement in a first position the connecting tube, by way of the rotary drive, can be adjusted into a second position that is offset by 90° or 180° with respect to the first position. In this second position a further measurement can be carried out. This enables a so-called turnover measurement, with which measurement errors can be compensated or reduced to a minimum degree. Basically, a measurement can also be carried out in more than two different rotational positions of the connecting tube.

Generally, the measuring arrangement can already be used with one measuring cable for specific applications. According to a further development of the invention it is especially advantageous that at least two measuring cables are provided which are attached to the working apparatus by being horizontally spaced apart from each other. By preference, the at least two measuring cables run parallel to each other in a normal position. By arranging at least two measuring cables it is also possible to realize a rotation of the working apparatus in space, in with a separate angular measurement being carried out on each measuring cable. Provision can also be made for three or more measuring cables that extend between the working apparatus and a respective fixed point. For a precise measurement the measuring cables have to be in a tensioned state, for which a tensioning means is to be provided. If only one measuring cable is arranged a rotation can be detected by way of a suitable detection means, as for example with a gyroscope.

Particularly good axial fixing of the measuring cable on the working apparatus by way of the connecting means can be achieved in that inside the connecting tube a pull element is arranged. More particularly, the pull element can be a pull cable that further enables sufficient deflection of the connecting tube in a direction transverse to the vertical measurement axis.

The invention further comprises a removal device for producing a hole, in particular a trench in the ground, with a working apparatus which has at least one removal tool for removing ground, a carrier implement, on which the working apparatus is supported in a vertically adjustable manner for introduction into the ground, wherein a measuring arrangement according to the invention for measuring the position, in particular the verticality, of the working apparatus in the ground is arranged. By making use of the measuring arrangement according to the invention on the removal device the previously described advantages can be achieved thereby.

The working apparatus can be an apparatus for special foundation engineering and in particular comprise a diaphragm wall cutter, a diaphragm wall grab or also a down-the-hole drilling apparatus or a drilling tool. The carrier implement is in particular a construction machine with a movable undercarriage, on which a rotatable upper carriage is supported. The undercarriage can in particular comprise a crawler-track running gear.

An especially preferred embodiment of the removal device according to the invention resides in the fact that the measuring cable has a density which is equal to or lower than the density of a slurry, with which the hole produced by the working apparatus is filled. Especially in the case of a density equal to that of a slurry at its surface in the hole undesirable effects on the cable due to density differences can be avoided. This increases the reproducibility of the measurement result. The density of the suspension can be constant or change depending on the depth.

With regard to the removal device a measurement by the measuring arrangement can take place continuously or at predetermined points in time. Depending on the measured values ascertained a deviation of the position of the working apparatus in the hole can be established at an early stage. Basically, the working apparatus can then be re-controlled manually.

According to a further development of the invention it is particularly preferred that the working apparatus is provided with actuatable positioning members for change of position of the working apparatus in the hole and in that on the control device a control and evaluation unit is provided and designed to check a position of the working apparatus and change this by actuating the positioning members depending on the measured values of the at least one measuring means. In particular, an automatic control or regulation of the position of the working apparatus in the ground can thereby take place. As a result, positionally accurate holes and in particular trenches can be produced in a simple manner in the ground. This makes it possible to keep a generally customary overlap between adjoining diaphragm wall segments to a very low level, so that when producing a diaphragm or cut-off wall there is due to this considerable saving of material and wear on the removal tools.

According to a further development of the invention a particularly advantageous removal device is achieved in that on the carrier implement a winch is provided for each measuring cable, by which the measuring cable can be tracked to the working apparatus whilst being under predeterminable pretension. The pretension can in particular be set in such a way that the measuring cable is completely tensioned at all times, while a sensitive deflection of the measuring cable and thus a high measurement accuracy are still given. This can be achieved by setting a corresponding starting torque on a winch drive for the winch.

Basically, the at least one fixed point can be provided in any suitable place that allows a reliable and permanent localization of the measuring cable. In particular, it is especially expedient that the at least one fixed point is designed and calibrated on a lead frame which is arranged at an upper end of the hole. Especially when producing a diaphragm wall a guide trench with concreted walls is produced along a ground surface. Along this guide trench a lead frame, preferably consisting of metal, can be arranged and fixed. On this lead frame fixed points for the measuring cable can be localized by corresponding holding means. For this purpose, in particular a measuring sleeve and/or a deflection pulley can be arranged on the lead frame, by which or respectively via which the measuring cable is suitably guided. The fixed point can in particular be calibrated for an especially precise measurement so that e.g. a clear position definition is given in a construction site coordination system.

In principle, the working apparatus of the removal device can be any construction apparatus to produce a hole in the ground. According to a further development of the invention it is particularly advantageous that the working apparatus is a diaphragm wall cutter with at least one driven cutting wheel which is rotatably supported about a horizontal axis of rotation on a lower end of a cutter frame. In particular, two pairs of cutting wheels can be arranged by being offset horizontally with respect to each other on the underside of the cutter frame.

Figure 2:
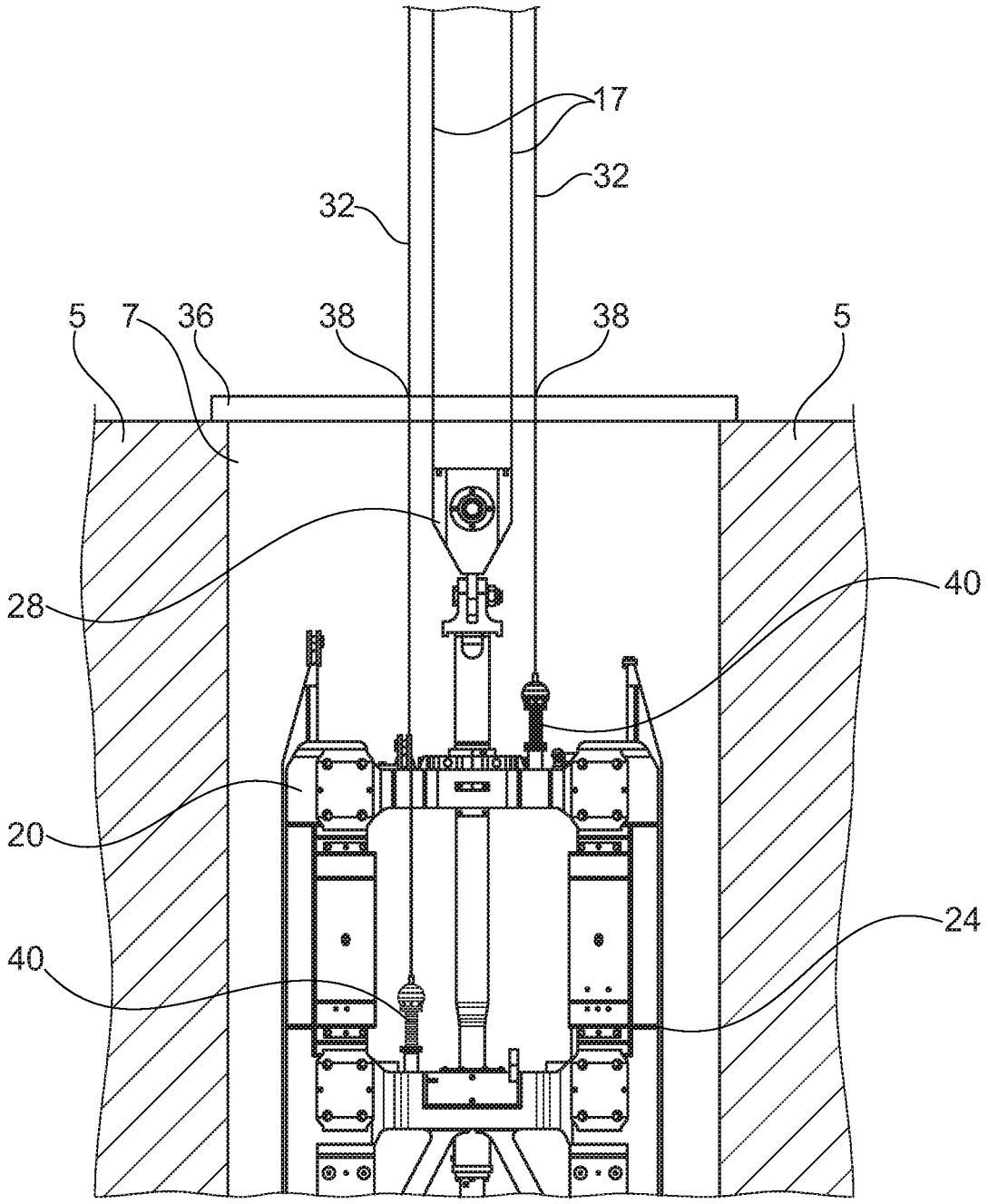
Figure 3:
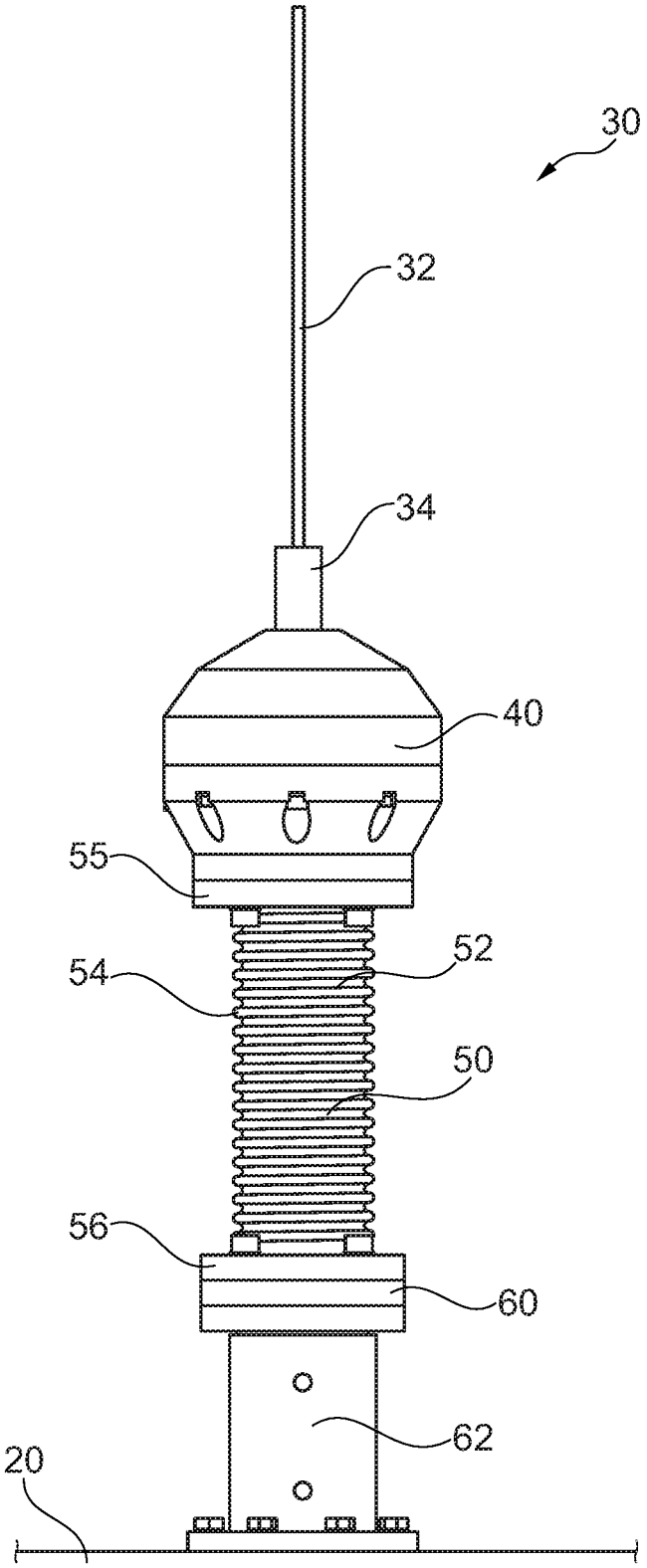

The invention is described further hereinafter by way of preferred embodiments illustrated schematically in the drawings, wherein show:

FIG. 1 a perspective view of a removal device with a measuring arrangement according to the invention;

FIG. 2 a detailed view of the measuring arrangement of FIG. 1 in a front view; and FIG. 3 an enlarged detailed view of a measuring means of a measuring arrangement according to the invention.

According to FIG. 1 a removal device 10 with a carrier implement 12 is illustrated which has a crawler-track running gear as undercarriage 13. On the undercarriage 13 an upper carriage 14 with an operator's cab 15 having the device control is rotatably supported about a horizontal axis of rotation. In the illustrated embodiment, as mast the removal device 10 has an extension mast 16 capable of being angled, via which a working apparatus 20 is held in a vertically adjustable manner by means of supporting cables 17.

In the illustrated embodiment the working apparatus 20 is designed as a diaphragm wall cutter 22 with a cutter frame 24. On the cutter frame 24 a plurality of extendable flap-shaped positioning members 25 is arranged, with which a position of the diaphragm wall cutter 22 in a hole in the ground can be changed and set in a known manner. At a lower end of the cutter frame 24 two pairs of cutting wheels 27 are rotatably supported as removal tools 26. In a known manner the cutting wheels 27 can be set into rotation via an internal cutting wheel drive in order to remove ground material.

To measure a position, in particular a verticality of the working apparatus 20 in the ground, a measuring means 40 of a measuring arrangement 30 according to the invention is attached in the region of a suspension means 28, via which the diaphragm wall cutter 22 is connected to the supporting cables 17. The measuring means 40, which will be described in greater detail hereinafter, is arranged approximately centrally and coaxially to the longitudinal axis of the working apparatus 20. From the measuring means 40 which is firmly connected to the working apparatus 20 a measuring cable 32 extends upwards to a defined fixed point 38 designed on a lead frame 36. The lead frame 36 is fixed at an upper end of the hole on the ground surface, in which case the fixed point 38 is calibrated and predetermines a target reference point for the position of the working apparatus 20.

The measuring cable 32 extends beyond the lead frame 36 high up as far as the carrier implement 12, in which case the measuring cable 32 is guided via deflection pulleys to a winch 18 on the upper carriage 14. Via the winch 18 the measuring cable 32 can be tracked to the working apparatus 20 which is being lowered into the ground and a certain tension of the measuring cable 32 can be ensured.

In a generally known manner, further lines and hoses for operation of the diaphragm wall cutter 22 are tracked from the carrier implement 12 via corresponding winches and drums.

In FIG. 2 an upper end of a modified working apparatus 20 with a total of two measuring means 40 is depicted, with a cutter frame 24 having already been introduced into a ground 5 while a hole 7 or trench is being formed.

The two measuring means 40 are fixed on the cutter frame 24 by being horizontally and vertically offset. From each measuring means 40 a measuring cable 32 extends upwards through a lead frame 36 which is placed onto the surface of the ground above the hole 7. The measuring cables 32 are each guided through a predetermined fixed point 38 on the lead frame 36 which serves as a reference point for position measurement and in particular the measurement of the verticality of the working apparatus 20 in the ground 5.

If the working apparatus 20 is located in the target position the measuring cables 32 extend precisely vertically to the vertical measurement axis through the respective fixed point 38. If a positional deviation occurs in the horizontal direction, this results in a deflection of at least one of the measuring cables 32 with respect to the vertical measurement axis. This deviation or angulation can be determined by the measuring means 40, as will be explained in greater detail hereinafter with reference to the illustration according to FIG. 3. Vertical adjustment of the working apparatus 20 takes place via the supporting cables 17 which are connected via a suspension means 28 to the working apparatus 20.

A preferred embodiment of a measuring arrangement 30 according to the invention with a measuring means 40 is illustrated schematically in FIG. 3. A measuring cable 32 is guided via a fixing sleeve 34 to an approximately ball-shaped measuring means 40 which is able to establish with high measuring accuracy a deviation and in particular an inclination of the measuring cable 32 with respect to a vertical measurement axis. The vertical measurement axis can in particular result from the direction of gravity.

The measuring means 40 is connected via a connecting means 50 to the working apparatus 20. The connecting means 50 has a connecting tube 52 extending in the vertical direction. The connecting tube 52 comprises a corrugated wall region and can be referred to as corrugated tube. A pull cable can extend inside and along the connecting tube 52. The connecting tube 52 can preferably be filled with liquid. By way of an upper fixing flange 55 the connecting tube 52 is firmly connected to the measuring means 40. By way of a lower fixing flange 56 the connecting tube 52 is attached to a rotary bearing 60, with which the connecting tube can be rotated about the vertical axis. For rotation provision is made below the rotary bearing 60 for a rotary drive 62, with which the connecting tube 52 can be adjusted in defined positioning angles with respect to the working apparatus 20. In this way, a measurement of the angle of inclination can take place in different rotational positions so that this also allows a determination of the position of the working apparatus 20 in space. The rotary drive 62 is connected via a flange connection to the working apparatus 20, in which case the connection is provided either on the frame of the working apparatus 20 or on the suspension means 28.

The invention claimed is:

1. A measuring arrangement for measuring a position, in particular a verticality, of a vertically adjustable and lowerable working apparatus with respect to an upper fixed point, with at least one measuring cable which is on the one hand connected to the vertically adjustable working apparatus and on the other hand extends towards the fixed point, at least one measuring means which is connected to the corresponding measuring cable and designed to measure an angle of inclination of the measuring cable relative to a vertical measurement axis and is arranged in a connection region between the measuring cable and the working apparatus, and at least one connecting means which is arranged between the measuring means and the working apparatus and is designed to keep the measuring means torque proof about the vertical measurement axis and at the same time capable of being angled with respect to the vertical measurement axis on the working apparatus, wherein the connecting means has a connecting tube which is arranged coaxially to the vertical measurement axis, and the connecting tube is designed so as to be torsion proof about the vertical measurement axis and deflectable with respect to the vertical measurement axis.

2. The measuring arrangement according to claim 1, wherein the connecting tube is formed in a hose-like manner from a flexible material.

3. The measuring arrangement according to claim 1, wherein the connecting tube is at least in sections designed as a corrugated tube with a corrugated wall region.

4. The measuring arrangement according to claim 3, wherein the corrugated tube is manufactured from metal, in particular steel.

5. The measuring arrangement according to claim 1, wherein the connecting tube is filled with an incompressible liquid.

6. The measuring arrangement according to claim 1, wherein at the end of the connecting tube which is directed towards the working apparatus a rotary bearing is provided, with which the connecting tube is rotatable about the vertical measurement axis, in particular about an angle of 180°.

7. The measuring arrangement according to claim 6, wherein a rotary drive is arranged for rotating the rotatably supported connecting tube in at least one different rotational position and the measuring means is designed to measure the angle of inclination in the different rotational positions.

8. The measuring arrangement according to claim 1, wherein at least two measuring cables are provided which are attached to the working apparatus by being horizontally spaced apart from each other.

9. The measuring arrangement according to claim 1, wherein inside the connecting tube a pull element, in particular a pull cable, is arranged.

10. A removal device for producing a hole, in particular a trench, in the ground, with a working apparatus which has at least one removal tool for removing ground, a carrier implement, on which the working apparatus is supported in a vertically adjustable manner for introduction into the ground, and a measuring arrangement for measuring the position, in particular a verticality, of the working apparatus in the ground, wherein a measuring arrangement according to claim 1 is arranged.

11. The removal device according to claim 10, wherein the measuring cable has a density which is equal to or lower than the density of a slurry, with which the hole produced by the working apparatus is filled.

12. The removal device according to claim 10, wherein the working apparatus is provided with actuatable positioning members for change of position of the working apparatus in the hole and on the carrier implement a control and evaluation unit is provided and designed to check a position of the working apparatus and change this by actuating the positioning members depending on the measured values of the at least one measuring means.

13. The removal device according to claim 10, wherein on the carrier implement a winch is provided for each measuring cable, by which the measuring cable can be tracked to the working apparatus whilst being under predeterminable pretension.

14. The removal device according to claim 10, wherein the at least one fixed point is designed and calibrated on a lead frame which is arranged at an upper end of the hole.

15. The removal device according to claim 10, wherein the working apparatus is a diaphragm wall cutter with at least one driven cutting wheel which is rotatably supported about a horizontal axis of rotation on a lower end of a cutter frame.

* * * * *